US012122546B2

(12) United States Patent
Biondi et al.

(10) Patent No.: US 12,122,546 B2
(45) Date of Patent: Oct. 22, 2024

(54) TRANSFER DEVICE AND TRANSFER PROCESS

(71) Applicant: G.D S.P.A., Bologna (IT)

(72) Inventors: Andrea Biondi, Bologna (IT); Luca Cavazza, Bologna (IT); Umberto Zanetti, Bologna (IT); Enrico Campagnoli, Bologna (IT); Antonio Gigante, Bologna (IT)

(73) Assignee: G.D S.P.A., Bologna (IT)

( * ) Notice: Subject to any disclaimer, the term of this patent is extended or adjusted under 35 U.S.C. 154(b) by 0 days.

(21) Appl. No.: 18/006,374

(22) PCT Filed: Jul. 26, 2021

(86) PCT No.: PCT/IB2021/056716
§ 371 (c)(1),
(2) Date: Jan. 20, 2023

(87) PCT Pub. No.: WO2022/029545
PCT Pub. Date: Feb. 10, 2022

(65) Prior Publication Data

US 2023/0234738 A1 Jul. 27, 2023

(30) Foreign Application Priority Data

Aug. 5, 2020 (IT) ..... 102020000019309

(51) Int. Cl.
*B65B 43/00* (2006.01)
*B65B 29/02* (2006.01)
(Continued)

(52) U.S. Cl.
CPC ..... *B65B 43/50* (2013.01); *B65B 29/022* (2017.08); *B65B 41/16* (2013.01); *B65B 61/065* (2013.01)

(58) Field of Classification Search
CPC ..... B65B 29/022; B65B 43/50
See application file for complete search history.

(56) References Cited

U.S. PATENT DOCUMENTS 10,384,819 B2 * 8/2019 Baraccani ..... B65B 57/14
10,472,105 B2 * 11/2019 Castellari ..... B65B 29/022
(Continued)

FOREIGN PATENT DOCUMENTS

DE 102017204541 A1 9/2018
EP 3040285 A1 * 7/2016 ..... B65B 29/02
IT 201800011153 A1 6/2020

OTHER PUBLICATIONS

International Search Report and Written Opinion for International Application No. PCT/IB2021/056716 filed on Jul. 26, 2021 on behalf of G.D S.P.A. Mail Date: Sep. 17, 2021 10 pages.

*Primary Examiner* — Eyamindae C Jallow
(74) *Attorney, Agent, or Firm* — Steinfl + Bruno LLP

(57) ABSTRACT

In a transfer device and a process for discrete elements, fed in a line with a predetermined spacing, variations in the dimensions of the discrete elements resulting in a variation in a release spot included in a release segment, are absorbed by an alignment of the receiving elements. A transport device of the transfer device has receiving elements, each configured to receive a respective discrete element and moving along a transport path at a predetermined speed. The discrete elements are transported on a release device of the transfer device along a release path with a linear development. The release path has a release segment intersecting the transport path at a receiving segment of the transport path. The transport device includes a moving mechanism for the receiving elements to align the receiving elements at the receiving segment, where the release segment is superimposed on the transport path at the receiving segment.

20 Claims, 4 Drawing Sheets

(51) Int. Cl.

| | |
|---|---|
| ***B65B 41/16*** | (2006.01) |
| ***B65B 43/50*** | (2006.01) |
| ***B65B 61/06*** | (2006.01) |

(56) References Cited

U.S. PATENT DOCUMENTS

| | | | | |
|---|---|---|---|---|
| 2016/0009427 | A1* | 1/2016 | Rea | B65B 35/18<br>53/282 |
| 2016/0144987 | A1 | 5/2016 | Scrivani | |
| 2017/0121044 | A1 | 5/2017 | Castellari et al. | |
| 2018/0215120 | A1* | 8/2018 | Rapparini | B31D 5/0082 |
| 2020/0290797 | A1 | 9/2020 | Steffen | |
| 2022/0048653 | A1 | 2/2022 | Biondi et al. | |

* cited by examiner

TRANSFER DEVICE AND TRANSFER PROCESS

CROSS REFERENCE TO RELATED APPLICATIONS

The present application is the US National Stage of International Patent Application No. PCT/IB2021/056716, filed on Jul. 26, 2021, which in turn, claims priority to Italian Application No. IT 102020000019309, filed on Aug. 5, 2020.

The present invention relates to a transfer device and process for discrete elements in a packaging apparatus and process.

The present invention finds a preferred, though not exclusive, application in the field of packaging of capsules for infusion type products, for example coffee, a field to which reference may be made hereinafter without loss in generality.

In particular, in the relevant technical field, transfer devices are known to couple together discrete elements of various kinds, and to apply a shaping process to these discrete elements by means of appropriate devices.

Therefore, the need to individually handle a quantity of discrete elements and to couple them together implies the need to transfer these discrete elements, in the packaging apparatus, from one station to another, i.e., by way of example, from a station where they are obtained by a cutting operation and with a predetermined format, to a subsequent station where the discrete elements are undergoing a shaping and coupling process.

In this description and in the accompanying claims as well, certain terms and expressions are deemed to have, unless otherwise expressly indicated, the meaning expressed in the following definitions.

Here and in the following, a discrete element is defined as an element formed from a single piece that must be individually processed at high speed, with the final aim of coupling it to a corresponding discrete target element.

In particular, it is envisaged that these discrete elements, downstream of any machining or extraction process or even pre-forming, are fed onto lines of discrete elements, through which a predetermined spacing between the discrete elements is achieved, allowing the intervention of tools, none of them interfering with discrete elements not being of their competence.

By way of example, a discrete element may consist of a component intended to be coupled with a capsule for infusion type products, which generally has a cup shape and which is supplied already shaped to the packaging process.

This discrete element may constitute the semi-finished product to obtain a filter or a lid for the capsule, and which will then have to be coupled to it by special coupling and shaping operations.

In the case of the filter, the discrete element may be a laminar element, e.g. shaped like a disc, made of a paper material to make infusion filters, i.e. allowing the filtering passage of a water-based infused liquid, without allowing an infusion material, such as ground coffee or shredded tea leaves, to pass through.

By way of example, these discrete elements can be fed one by one, or cut directly from a strip of suitable material using a cutting device.

Once fed, these discrete elements must each be placed on a respective receiving element for the necessary operations of transport, forming and application to the target capsule, although the present case concerns in particular the mere transfer of discrete elements from the respective feed on a line to a sequence of receiving elements.

It is understood that discrete elements, as well as receiving elements, are continuously transported when they move with a predetermined speed, possibly variable, i.e. subject to accelerations and decelerations, but never nihil. Continuous feeding and transport are therefore different from step feeding and transport, in which the corresponding discrete elements and/or receiving elements move step-by-step.

Feeding or transport "in a line" means that discrete elements are supplied in a sequence of discrete elements aligned with each other, resulting from an extraction or processing.

It is understood that in the line, each discrete element is spaced from the elements preceding and following it with a constant spacing, resulting from the extraction and/or processing step.

With "release device" it is meant a device providing said discrete elements in the above-mentioned manner.

With "Release segment" it is meant a segment along which said release device transfers discrete elements to a subsequent transport path. In particular, even when discrete elements are continuously fed, their release takes place at a release spot that belongs to the release segment, which can therefore be defined as the linear section over which the possible release points of a release device fall.

"Linear development", or more briefly "linear", i.e. a linear segment or path, means a segment or a path running along a clearly identifiable line, which may be straight, broken or curved, and possibly closed.

"Transport device" means any system designed to transport discrete elements while maintaining their respective singularity, i.e. without them interfering with each other in any way.

This type of transport is required so that discrete elements can be correctly selected, formed and then applied to a target element.

"Transport path" refers to the path travelled by the receiving elements intended to individually receive a respective discrete element.

The term "closed transport path" means a transport path of the receiving elements developing along a closed line on a substantially horizontal plane, while the term "carousel structure" means a transport device that operates on a closed transport path, letting the articles and the respective pincer devices, or in any case the movable devices therein provided, carry out a so called revolution which, for this reason, should not be confused with the alternated roundtrip motion that is typical for a belt conveyor.

"Receiving segment" means a portion of the transport path where the transfer of discrete elements released by the release device takes place. Therefore, the receiving segment and the release segment must be close to each other, for such a transfer to take place.

The Applicant noted that, in packaging processes, the speed of transfer and insertion of the articles to be packaged into the target packagings is crucial to the overall economics of the process, as high production volumes can be achieved with fewer packaging apparatuses.

Furthermore, the Applicant observed that, in addition to the need to proceed as quickly as possible, another important and unavoidable requirement is the flexibility required of this type of mechanism, in particular with regard to the different production formats, which entail the need to be able to operate, with the same apparatus, on different shapes and sizes of discrete elements.

This need is particularly felt when, in the case of capsules of different format, the discrete elements must adapt to the dimensions of the final filter, and are therefore supplied with different diameters.

The Applicant also verified that maintaining a minimum distance between the discrete elements being fed is an optimal processing condition, as it leads to a reduction in the passage time.

In addition, in the specific case of filters, they can be cut to the correct size from a continuous strip of suitable material, and maintaining a minimum distance allows less material to be discarded.

The Applicant found that, in general, maintaining this minimum spacing, together with the use of the highest possible transport speeds, results in different release speeds and even small but significant differences in the exact point at which the individual discrete element is released from the target transport device.

Although this requirement arises in both continuous and step feeding, especially in continuous feeding and at high speeds this problem requires adjustments in the transport path of the receiving elements.

The Applicant also understood that the transport path, at a receiving section, could be modified so that it could adapt to different formats of discrete incoming elements, thus determining the necessary flexibility and without having to intervene with an adjustment of the system during the format change.

The Applicant therefore perceived that the transport path could be permanently modified in a transport device by a correction of a mechanical nature acting on the individual receiving elements, provided that they can move limitedly with respect to the transport device itself.

Finally, the Applicant found that, with the movable receiving elements, it is possible to apply a movement mechanism to the transport device which is capable of meeting the requirements outlined above, without adversely affecting the operating speed, but allowing all the flexibility required.

In particular, in a first aspect thereof, the invention relates to a transfer device for discrete elements.

Preferably, discrete elements are fed in a line with a predetermined spacing.

Preferably, they are fed to a transport device having a plurality of receiving elements, each apt to receive a respective discrete element.

Preferably, the receiving elements are moving on a transport path at a predetermined speed.

Preferably, the transfer device comprises a release device on which said discrete elements are transported along a linear path having a linear development.

Preferably, said release path has a release segment, and intersects said transport path at one of the receiving segments thereof.

Preferably, the transfer device comprises moving mechanism for moving the receiving elements.

Preferably, in the transport device, the aforesaid movement mechanism is provided for aligning the receiving elements with each other at said receiving segment.

In this way, the release segment is superimposed on the transport path at said receiving segment.

Thanks to these features, it is possible to obtain a transfer device wherein any variations in the sizes of the discrete elements, which cause a variation in the release spot included in said release segment, are absorbed by the alignment of the receiving elements in the corresponding receiving segment.

Furthermore, thanks to these features, the packaging apparatus does not require the transport device to be phased during format changes.

In a second aspect thereof, the invention concerns a transfer process for discrete elements.

Preferably, discrete elements are fed in a line with a predetermined spacing.

Preferably, they are fed on a transport path defined by a plurality of receiving elements, each apt to receive a respective discrete element.

Preferably, the receiving elements move at a predetermined speed.

Preferably, said discrete elements are transported along a linear path having a linear development which has a release segment, and which intersects said transport path at its receiving segment.

Preferably, the transfer process includes a step of aligning the receiving elements to each other at said receiving segment, thereby the release segment is superimposed to the transport path at said receiving section.

In other words, the opportunity of aligning the receiving elements to each other in the passage at the release segment makes the position of the exact point in the release segment where the discrete element leaves it to rest on the receiving element irrelevant.

Furthermore, since the receiving elements are synchronised without interrupting the transport process, the latter need not to be slowed down.

Thus, ideally, in the transfer process according to the invention, it is possible to change the format of the discrete elements without the need of carrying out any other adjustments to the transport of the receiving elements.

In a third aspect thereof, the present invention relates to a packaging apparatus comprising a transfer device for discrete elements according to the first aspect of the invention, as above outlined.

In other words, this apparatus comprises a transfer device allowing the passage of discrete elements from a release device to a transport device not requiring any adjustment in the transport device if the format of the discrete elements is changed.

In at least one of the aforesaid aspects, the present invention may further comprise at least one of the following preferred features.

Preferably, this transport path runs along a closed line, in which said receiving elements circulate on the transport path.

In this way, the transfer device can employ a fixed number of receiving elements rotating in a revolution.

Preferably, the transport device comprises a carousel structure having a rotary drum on which said receiving elements are mounted.

In this way, the mechanics of the device are greatly simplified.

Preferably, the transport path is essentially circular.

This makes the transfer device particularly compact.

Preferably, said discrete elements are continuously fed, allowing high transfer speeds to be achieved.

Preferably, said receiving elements continuously move along the transport path, still allowing high transfer rates to be achieved.

Preferably, the movement mechanism comprises, for each receiving element, a rotatable articulation driven by the transport device.

This makes possible to precisely determine the position of the receiving elements in their transport path.

Preferably, the articulation comprises at least one movable around a fulcrum lever, a mechanism being provided for rotating the lever around the fulcrum thereof.

Preferably, said rotation mechanism comprises a cam follower, connected to said lever at its fulcrum, which moves on a cam determining the alignment of the transport elements at the receiving segment.

In this way, this purely mechanical solution makes the whole system simpler and error-proof.

Preferably, said linear release path is defined by a flat strip from which said discrete elements are cut.

In this way, discrete elements can be produced on the spot from a material supplied in reels.

Preferably, the release device comprises a cylindrical feeder which is rotated, at said release segment, about an axis parallel to a plane in which the discrete elements are released, and which has, on its surface, a device for retaining and then releasing laminar discrete elements.

This ensures that the discrete elements are delivered, in particular, on a linear, straight release path.

Preferably, to retain the discrete element in a fixed reference position, the receiving element receiving the discrete element comprises a vacuum forming suction system between the receiving surface of the receiving element and the discrete element.

This allows the discrete element to be associated with the receiving element at a predefined position.

The present invention will hereinafter be described according to a preferred embodiment example thereof, which is provided for illustrative and non-limiting purposes with reference to the accompanying drawings in which.

Figure 1:
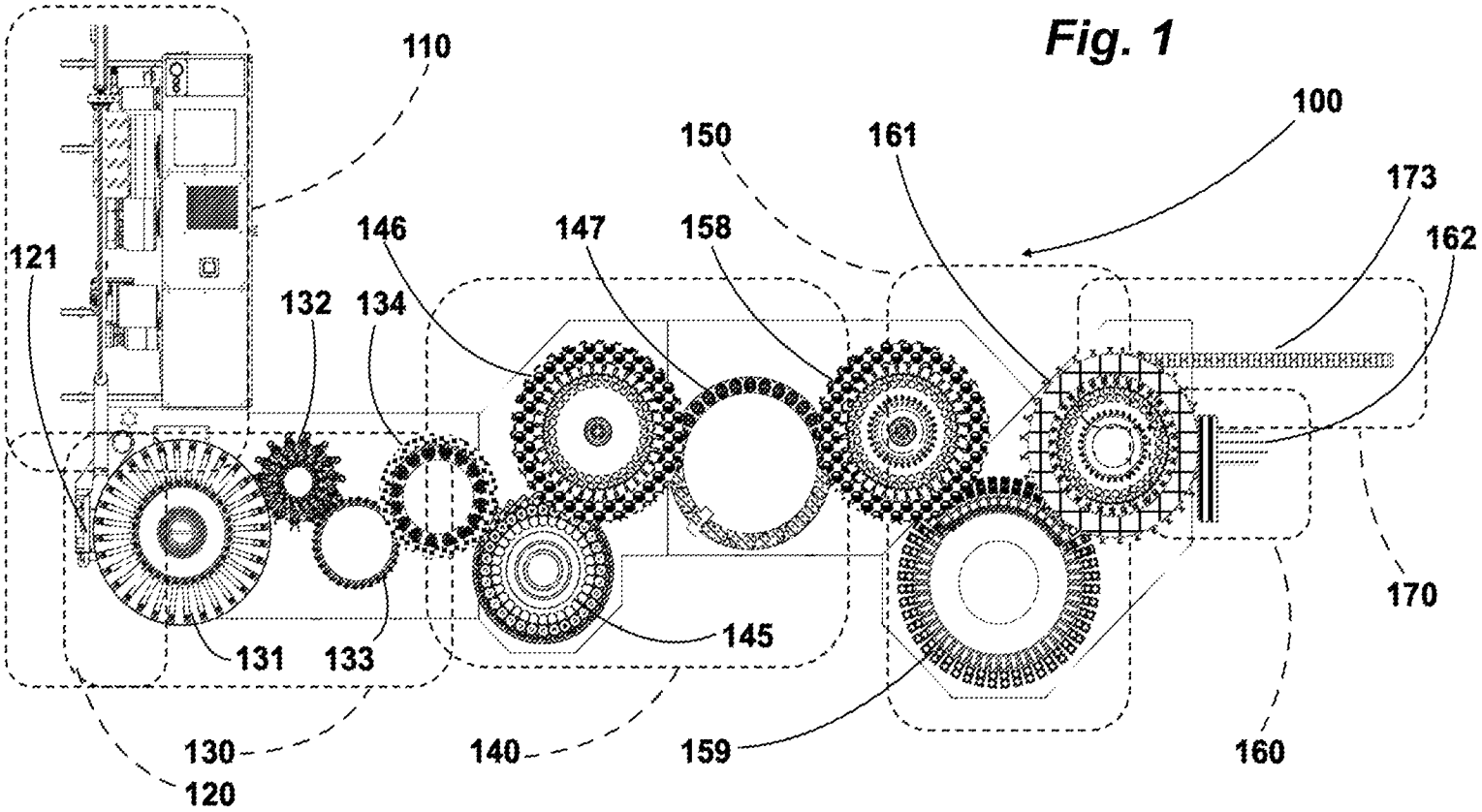
FIG. 1 shows a plan view of an embodiment of a packaging apparatus comprising a discrete element transfer device made according to the present invention.
Figure 2:
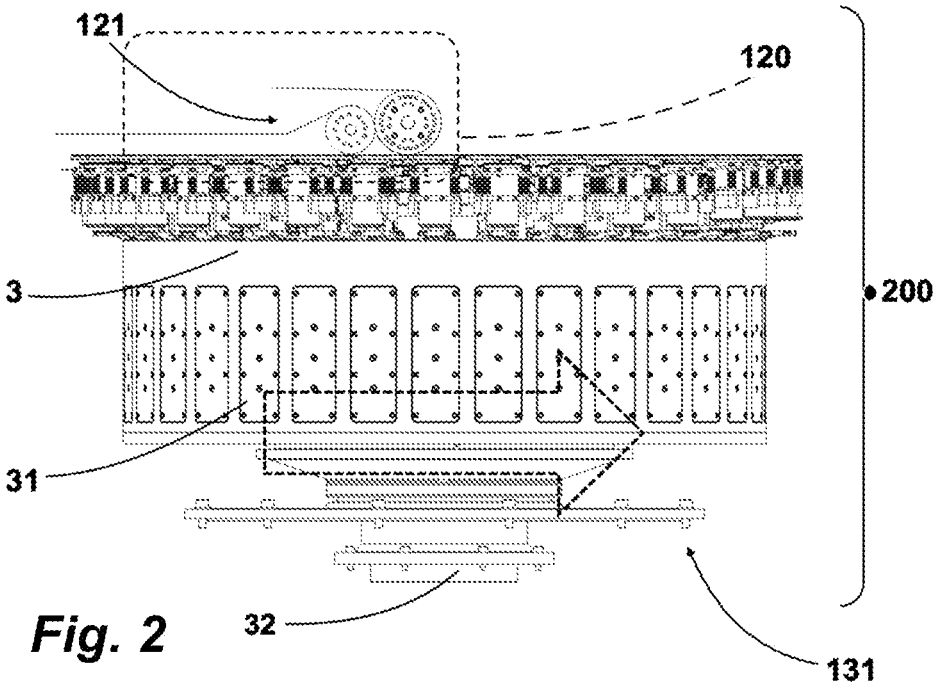
FIG. 2 shows a side elevation view of a transfer device made according to the present invention.
Figure 3:
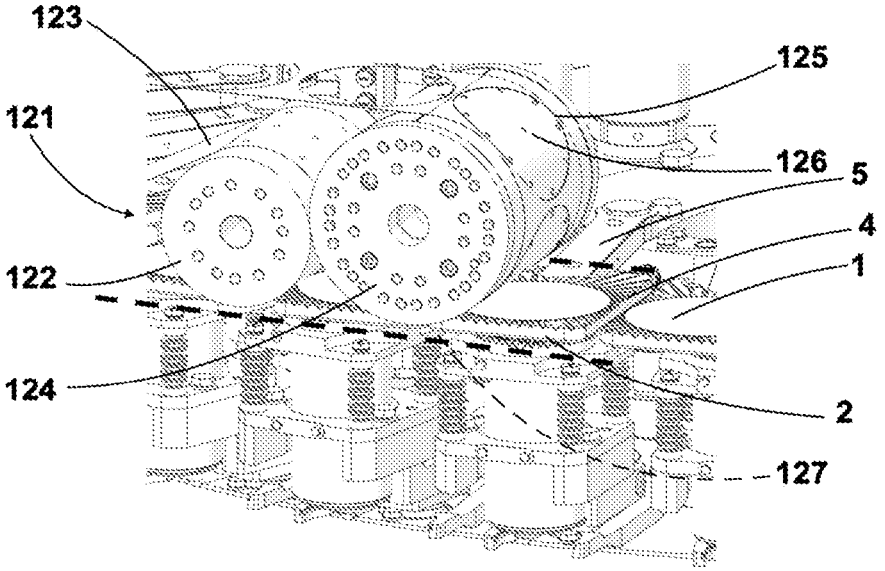
FIG. 3 shows a side perspective view of a second detail of the transfer device in FIG. 2.

With reference to the accompanying FIG. 1, an apparatus for packaging capsules for infusion type beverages, such as coffee, is referenced by 100.

These capsules consist of a substantially rigid cup-shaped container, inside which a filter and a coffee powder preparation is placed, and then they are sealed with a lid and sent to a subsequent apparatus where they are boxed for distribution and sale.

In general, the cup-shaped containers are supplied by a feeding station 110, from which they proceed in a line with a continuous motion after being extracted from a set of cup-shaped containers provided by a supplier.

The packaging apparatus 100 comprises a release station 120 of discrete elements, which will be indicated in the following figures by 1, which in the present example comprise flat discs of a material suitable for shaping a filter for infusion type beverages.

Thus, the release station 120 comprises a release device 121 which, in the present example, is a device for cutting said discs from a continuous strip of filter material.

The release device 120 thus provides discrete elements 1, in the form of discs, which are fed individually, i.e. one by one, after a cutting step, in a single line with a predetermined spacing between one discrete element and a subsequent discrete element.

The packaging apparatus therefore comprises a filter shaping station, indicated by 130, which comprises a carousel-like transport device 131, which will be described in greater detail later.

The transport device 131 is part of a more complex station, in which said discrete elements 1, once transferred from the release device 121 to the transport device 131, undergo a filter shaping process, which is then inserted inside a target cup-shaped container, which will possibly contain on its bottom a spacer element inserted inside it in the feed station 110.

After the filter has been inserted into the respective container, the filter is fixed, e.g. by welding, to the inside walls of the cup-shaped container.

In this connection, the transport device 131 transfers the cup-shaped containers with filters to a first transfer wheel 132, and from this they pass to a filter fixing wheel 133, then to pass to a second transfer wheel 134 which transfers the cup-shaped containers to a filling station 140, where they are filled with a predetermined dose of coffee powder.

In this regard, the filling station comprises a carousel-like filling device 145 from which the cup-shaped containers are transferred, by means of a third transfer wheel 146, to a carousel-like weighing device 147, performing a check on the amount of powder supplied to each container.

Upon leaving the weighing device 147, the containers are transferred by a fourth transfer wheel 158 to a sealing station 150. The apparatus 100 thus comprises a cutting station 160 for lids that are formed from a continuous strip by a cutting device 162.

The lids, which have a disc shape, are transferred, by means of a fifth transfer wheel 161, to a sealing device 159, also structured as a carousel, which receives the containers to be sealed from said fourth wheel 158 and which provides for the extraction of the gases from the cup-shaped container and for its sealing by applying on its upper opening a disc-shaped lid made from continuous strip.

Note how the cutting device 162 could constitute, in an alternative version of the apparatus, an additional release device.

Once sealed, the containers are sent to an outlet station 170, equipped with a linear transport device 173.

With reference to FIGS. 2 to 5, the transfer device described herein, and referred to as a whole as 200, which embodies the present invention, comprises said release device 121 and said transport device 131, having a carousel-like structure.

The release device 121 comprises a first roller-like drum 122 receiving a continuous strip 123 from a feeding reel, not shown and of a substantially conventional type.

A second roller-like drum 124 receives the strip 123 from the first roller-like drum 122: on it are formed cutting elements 125 shaped as discs which act on the strip 123.

In particular, the two roller-like drums 122, 124 are arranged side by side and rotate around parallel rotation axes; they roll, creating a contact zone through which the strip 123 is passed.

The first roller-like drum 122 acts as a contrast element for the cutting elements 125 which, in said contact zone, score the strip 123 and thus create the discrete elements 1.

They remain attached to the second roller-like drum 124 which, for this purpose, incorporates a suction device with suction openings 126 arranged on its cylindrical surface.

The suction ceases in the zone of the second roller-like drum 124 facing downwards: along a release path with a linear development 127, which is part of a release path defined by a flat strip 123 from which the discrete elements 1 are cut.

Therefore, the second roller-like drum 124 acts as a cylindrical feeder which is rotated, at said release segment 127, about an axis parallel to a plane on which the discrete elements 1 are released, and which has on its surface a device for retaining and then releasing discrete laminar elements, which is realised by said suction device.

In the present example, considering that the roller-like drums rotate at a predetermined speed while performing the cutting operation described above, the discrete elements 1 are then continuously fed.

The transport device 131 has a plurality of receiving elements 2, each apt to receive a respective discrete element 1, which are movable by moving along a transport path at a predetermined speed and continuously.

The transport device is of the carousel structure with a rotary drum 3 on which the receiving elements 2 are mounted.

The rotary drum 3 comprises a cylindrical body 31 rotating about a vertical axis, defined by a hub 30, and supported by a base 32 fixed and integral with a frame not shown, and thus the receiving elements 2 move in a substantially horizontal plane on which said transport path lies.

Each receiving element 2 comprises a horizontal flat surface, on which said discrete elements are released, which has a surface knurling 4 to realise the friction between discrete element 1 and receiving surface which, in subsequent shaping operations, concur to form a surface pleat of the filter.

In order to retain the discrete element 1 in a fixed reference position, the receiving element 2 may comprise a vacuum forming suction system between the receiving surface and the discrete element.

In this embodiment, the transport path of the receiving elements 2 develops along a closed line, in which said receiving elements circulate on the transport path, and in particular the transport path is substantially circular because it is formed on the periphery of said rotary drum 3.

In view of the foregoing, said discrete element release path 1, and in particular release segment 127, intersects said receiving element transport path 2 at a receiving segment thereof, located in proximity to release device 121.

The transport device 131 comprises a movement mechanism of the receiving elements 2 that operates to achieve a step whereby the receiving elements 2 are aligned with each other at said receiving segment.

In this way, the release segment 127 overlaps with the transport path at the receiving segment, overlapping it along its entire length.

Thus, the receiving elements 2 are movable and the movement mechanism comprises, for each receiving element 2, a rotatable articulation which is driven by the transport device 131 because it is integral with the rotary drum 3.

Said articulation comprises a system of levers articulated with each other, capable of moving the receiving element with three degrees of freedom, i.e., capable of raising and lowering it with respect to the rotary drum, of rotating it on itself around an axis perpendicular to it, and of roto-translating it thanks to a main lever 5 movable around a fulcrum 6 which is connected to a mechanism of rotation of the lever 5 around its fulcrum 6.

This rotation mechanism can be realised in many ways, for example by an electric motor adjusting the position of the lever 5 by making a so-called electronic cam.

Otherwise, it is possible to realise such a mechanism with only mechanical parts. For example, the rotational mechanism comprises a cam follower which is connected to said lever 5 at its fulcrum 6.

The aforesaid cam follower is therefore dragged by the rotary drum but interacts with a cam, integral with the base 32, moving on it.

The shape of the cam is such as to determine a rotation of the lever 5 such that the alignment of the transport elements 2 at the receiving segment, i.e. said release segment 127 of the release device 121, is determined.

Other cams may preside over the movement of the remaining two degrees of freedom.

Figure 4A:
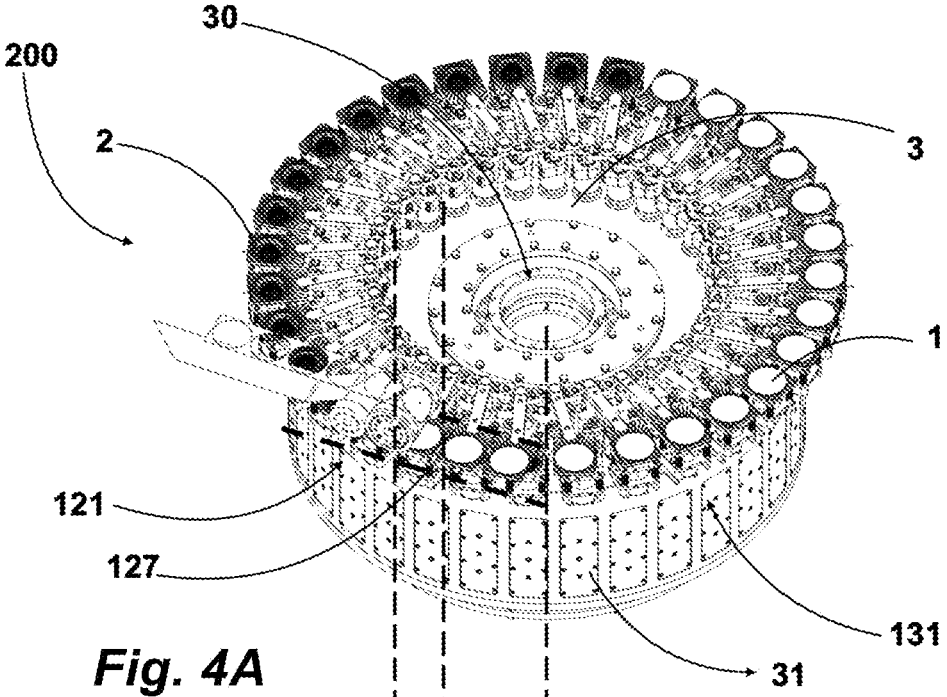
FIGS. 4A and 4B show respective perspective views of another detail of the transfer device in FIG. 2, comparing two different operating situations.
Figure 4B:
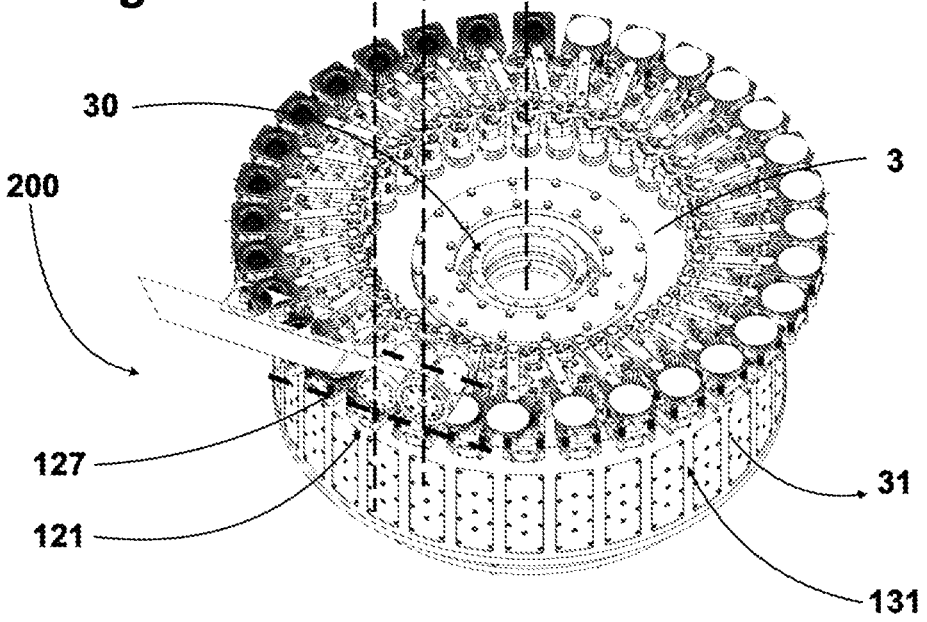
Figure 5:
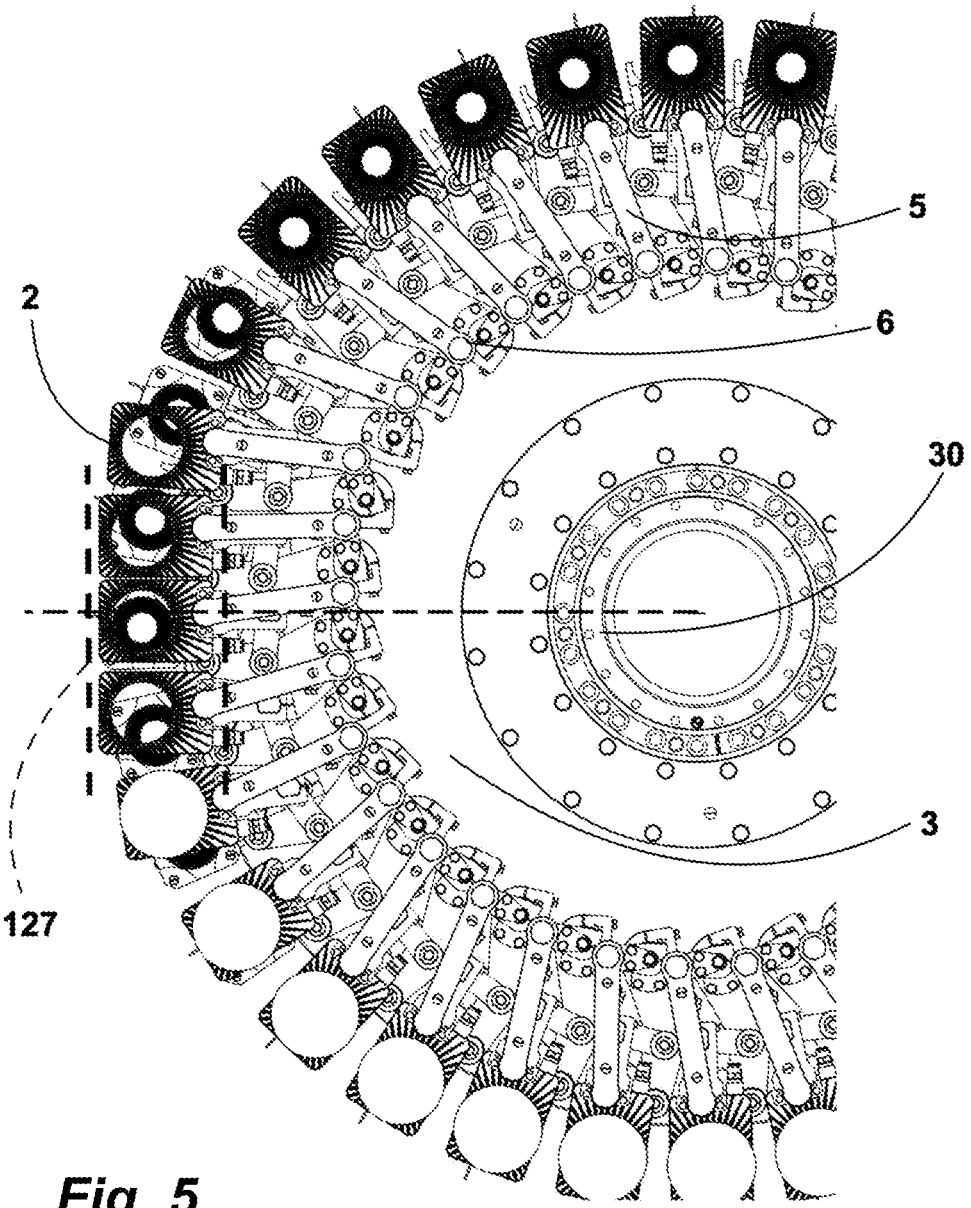
FIG. 5 shows a plan view from below of a first detail of the transfer device in FIG. 2.

With reference to FIGS. 4A and 4B, a variation of the release spot in said release segment 127 of the release device 121 is illustrated: a change of format, achieved by changing the format of the cutting elements 125 on the second roller-like drum 124, causes a shift in the point at which the discrete element 1 is released.

In any case, this spot falls in the receiving segment in which the receiving elements 2 are aligned to each other, although they continue to rotate continuously, driven by the rotary drum 3.

This alignment ensures that the transfer of discrete elements 1 is successful whatever the point of release in the release segment.

To the above-described transfer device, a person skilled in the art may, in order to meet additional and contingent requirements, make numerous further modifications and variations, all of which are, however, within the scope of protection of the present invention as defined by the appended claims.

The invention claimed is:

1. A transfer device for discrete elements, the transfer device comprising:

(i) a transport device to which the discrete elements are configured to be fed through a line with a predetermined spacing, the transport device comprising:

(ia) a transport path comprising a receiving segment, (ib) receiving members, each configured to receive a respective discrete element, the receiving members moving along the transport path of the receiving members at a predetermined speed, and (ic) a moving mechanism for the receiving members, the moving mechanism being configured to mechanically correct alignment of the receiving members to each other at said receiving segment, (ii) a release device, on which said discrete elements are configured to be transported, the release device comprising:

(iia) a release path with a linear development for the discrete elements, the release path having a release segment and crossing said transport path at the receiving segment of the transport path, wherein the release segment is superimposed on the transport path at said receiving segment.

2. The transfer device according to claim 1, wherein said transport path extends along a closed line, whereon said receiving members are configured to move along said transport path.

3. The transfer device according to claim 2, wherein the transport device comprises a carousel-like structure having a rotary drum, the receiving members being mounted on the rotary drum.

4. The transfer device according to claim 3, wherein the transport path is substantially circular.

5. The transfer device according to claim 1, wherein said discrete elements are fed in a continuous manner.

6. The transfer device according to claim 1, wherein said receiving members move continuously along the transport path.

7. The transfer device according to claim 1, wherein the moving mechanism comprises, for each receiving member, a rotatable articulation configured to be actuated by the transport device.

8. The transfer device according to claim 1, wherein said release path is defined by a planar strip from which said discrete elements are cut.

9. The transfer device according to claim 8, wherein the release device comprises a cylindrical feeder, and the cylindrical feeder is configured to be rotated, at said release segment, about an axis parallel with a release plane for the discrete elements.

10. The transfer device according to claim 9, further comprising:

a retain and release suction device for retaining and then releasing the discrete elements on a surface of the retain and release suction device.

11. The transfer device according to claim 1, wherein each receiving member comprises a horizontal planar surface, on which said discrete elements are configured to be released.

12. A process for transferring discrete elements, comprising:

feeding the discrete elements, along a line with a predetermined spacing, on a transport path defined by receiving members i) configured to receive a respective discrete element and ii) moving at a predetermined speed, wherein the feeding comprises conveying the discrete elements along a release path with a linear development, the release path having a release segment and crossing said transport path at a receiving segment of the transport path, and correcting an alignment of the receiving members to each other at said receiving segment, wherein the release segment is superimposed on the transport path at said receiving segment.

13. A packaging apparatus comprising the transfer device according to claim 1.

14. A transfer device for discrete elements, the transfer device comprising:

a transport device to which the discrete elements are configured to be fed through a line with a predetermined spacing, the transport device comprising receiving members, each configured to receive a respective discrete element, the receiving members moving along a transport path of the receiving members at a predetermined speed, and a release device, on which said discrete elements are configured to be transported, the release device comprising a release path with a linear development for the discrete elements, the release path having a release segment and crossing said transport path at a receiving segment of the transport path, wherein the transport device further comprises:

a moving mechanism for the receiving members, the moving mechanism being configured to align the receiving members to each other at said receiving segment, and the moving mechanism comprising, for each receiving member, a rotatable articulation configured to be actuated by the transport device, wherein the release segment is superimposed on the transport path at said receiving segment.

15. The transfer device according to claim 14, wherein said transport path extends along a closed line, whereon said receiving members are configured to move along said transport path.

16. The transfer device according to claim 15, wherein the transport device comprises a carousel-like structure having a rotary drum, the receiving members being mounted on the rotary drum.

17. The transfer device according to claim 16, wherein the transport path is substantially circular.

18. The transfer device according to claim 14, wherein said discrete elements are fed in a continuous manner.

19. The transfer device according to claim 14, wherein said receiving members move continuously along the transport path.

20. The transfer device according to claim 14, wherein said release path is defined by a planar strip from which said discrete elements are cut.

* * * * *